US006663396B1

(12) United States Patent
Wang

(10) Patent No.: US 6,663,396 B1
(45) Date of Patent: Dec. 16, 2003

(54) ELECTRIC PLUG HAVING HORIZONTAL/ VERTICAL INSTALLATION MODES

(76) Inventor: Ming-Shan Wang, No. 16, Alley 25, Lane 127, Lin Sen Road, Kweishan Hsiang, Taoyuan Hsien (TW)

( * ) Notice: Subject to any disclaimer, the term of this patent is extended or adjusted under 35 U.S.C. 154(b) by 18 days.

(21) Appl. No.: 10/183,677

(22) Filed: Jun. 28, 2002

(51) Int. Cl.[7] ..... H01R 39/00
(52) U.S. Cl. ..... 439/31
(58) Field of Search ..... 439/31, 11, 13, 439/18, 20–22, 483, 484, 372, 692, 693, 694, 601, 602, 103, 101, 107

(56) References Cited

U.S. PATENT DOCUMENTS 5,516,305 A * 5/1996 Haluska ..... 439/484
5,567,181 A * 10/1996 Lentz et al. ..... 439/694
5,658,152 A * 8/1997 Selker ..... 439/31

* cited by examiner

*Primary Examiner*—Lynn Feild
*Assistant Examiner*—Son V. Nguyen
(74) *Attorney, Agent, or Firm*—Rosenberg, Klein & Lee

(57) ABSTRACT

An electric plug is constructed to include a front housing having a plurality of notches formed in aligned manner along a rear side thereof. A set of conducting blades are mounted in the front housing such that they extend outward in a direction perpendicular to a front side of the front housing for insert into an electric outlet. The conducting blades are formed with rear ends which respectively extend into the notches of the front housing. A rear housing is pivotally coupled to the front housing, and a set of metal terminals are mounted in the rear housing and respectively pivoted to the rear ends of the conducting blades for enabling the rear housing to be turned relative to the front housing between two positions within 90 degrees.

6 Claims, 13 Drawing Sheets

ELECTRIC PLUG HAVING HORIZONTAL/VERTICAL INSTALLATION MODES

BACKGROUND OF THE INVENTION

1. Field of the Invention

The present invention relates to an electric plug and, more particularly, to such an electric plug, which is comprised of a front housing holding a set of conducting blades, and a rear housing hinged to the front housing and holding a set of metal terminals, which are respectively pivoted to the conducting blades for enabling the rear housing to be turned relative to the front housing between two positions within 90°.

2. Description of the Related Art

FIG. 1 illustrates an electric plug 1 according to the prior art. This structure of electric plug 1 comprises an electrically insulative housing 12, and two conducting blades 1 axially forwardly extended out of the front side of the housing 12. According to this design, the housing 12 is perpendicularly protruded from the front side of the electric outlet after installation of the electric plug. FIG. 2 illustrates another structure of electric plug according to the prior art. According to this design, the electric plug 2 comprises an electrically insulative housing 22, two conducting blades 21 perpendicularly extended out of the housing 22, and a pull ring 24 pivoted to the housing 22. This design occupies less installation space. Through the pull ring 24, the user can pull the electric plug 2 away from the electric outlet with less effort. However, when pulling the pull ring 24, a concentration of stress is produced, and the housing 22 tends to be damaged, causing the pull ring 24 to disconnect from the housing 22. This design of electric plug occupies less vertical installation space, however it occupies much horizontal installation space. When the electric plug 2 installed in an electric outlet in the wall near the floor, the power cord 23 of the electric plug 2 may have to be bent to a particular direction. In this case, the inside conductors of the power cord 23 tend to be broken. FIG. 3 shows still another structure of electric plug according to the prior art (Taiwan Patent Publication No. 431695). According to this design, the electric plug 3 comprises a bottom cover shell 31, a wheel 32, two conducting blades 33, two metal terminals 34, a power cord 35, and a top cover shell 36. The conducting blades 33 are coupled to the wheel 32 and respectively pivoted to the metal terminals 34. The wheel 32 can be rotated in front openings 311;361 of the cover shells 31;36. When in use, as shown in FIG. 4, the cover shells 31;36 can be turned with the metal terminals 34 relative to the conducting blades 33 and the wheel 32 within 180° (90° leftwards and 90° rightwards). However, when the electric plug 3 installed in the left socket unit 371 of a multi-socket electric outlet 37, the electric plug 3 will block the adjacent socket unit 372 of the electric outlet 37 if the user turn the cover shells 31;36 to the right side relative to the conducting blades 33. Further, this design is not suitable for a three-pole electric plug fitting a three-pole electric socket.

Therefore, it is desirable to provide an electric plug that eliminates the aforesaid drawbacks.

SUMMARY OF THE INVENTION

The present invention has been accomplished to provide an electric plug, which eliminates the aforesaid drawbacks. It is one object of the present invention to provide an electric plug, which can be alternatively set between two positions to minimize the occupation of installation space. It is another object of the present invention to provide an electric plug, which is suitable for a two-pole design as well as a three-pole design. To achieve these and other objects of the present invention, the electric plug comprises a front housing formed of a bottom cover shell and a top cover shell, the front housing comprising a plurality of insertion slots in the bottom cover shell thereof, and a plurality of notches in a rear side thereof; a rear housing formed of a bottom cover shell and a top cover shell and pivoted to the front housing, the rear housing comprising a plurality of knuckles protruded from a front side thereof and respectively pivoted to the notches of the front housing; a plurality of conducting blades mounted in the housing and respectively extended out of the insertion slots of the front housing in direction perpendicular to a front side of the front housing, the conducting blades each having a rear end respectively suspended in the notches of the front housing; and a plurality of metal terminals mounted in the rear housing and connected to a power cord, the metal terminals each having a front end respectively pivoted to the rear ends of the conducting blades in the notches of the front housing for enabling the rear housing to be turned relative to the front housing between a first position where the front housing and the rear housing are maintained horizontally aligned, and a second position where the front housing and the rear housing are maintained at right angles.

DETAILED DESCRIPTION OF THE PREFERRED EMBODIMENT

Figure 1:
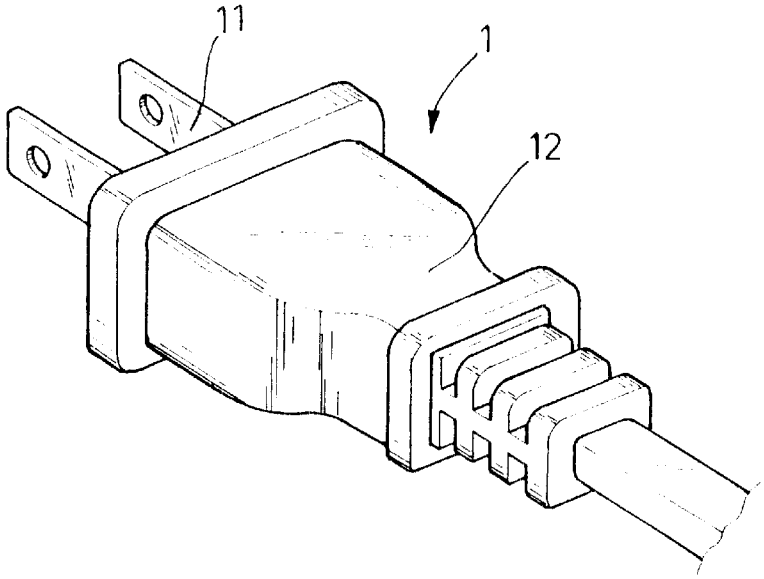
FIG. 1 PRIOR ART
FIG. 1 is an elevational view of an electric plug according to the prior art.
Figure 2:
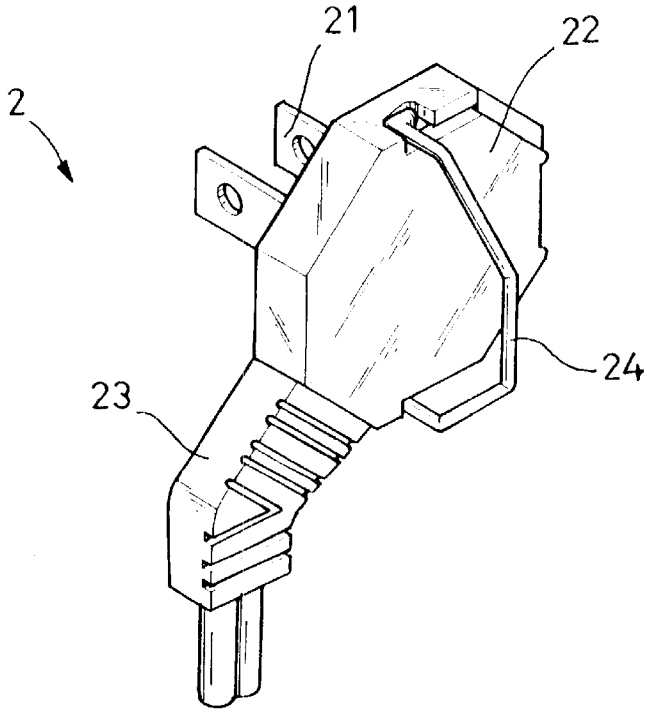
FIG. 2 PRIOR ART
FIG. 2 is an elevational view of another structure of electric plug according to the prior art.
Figure 3:
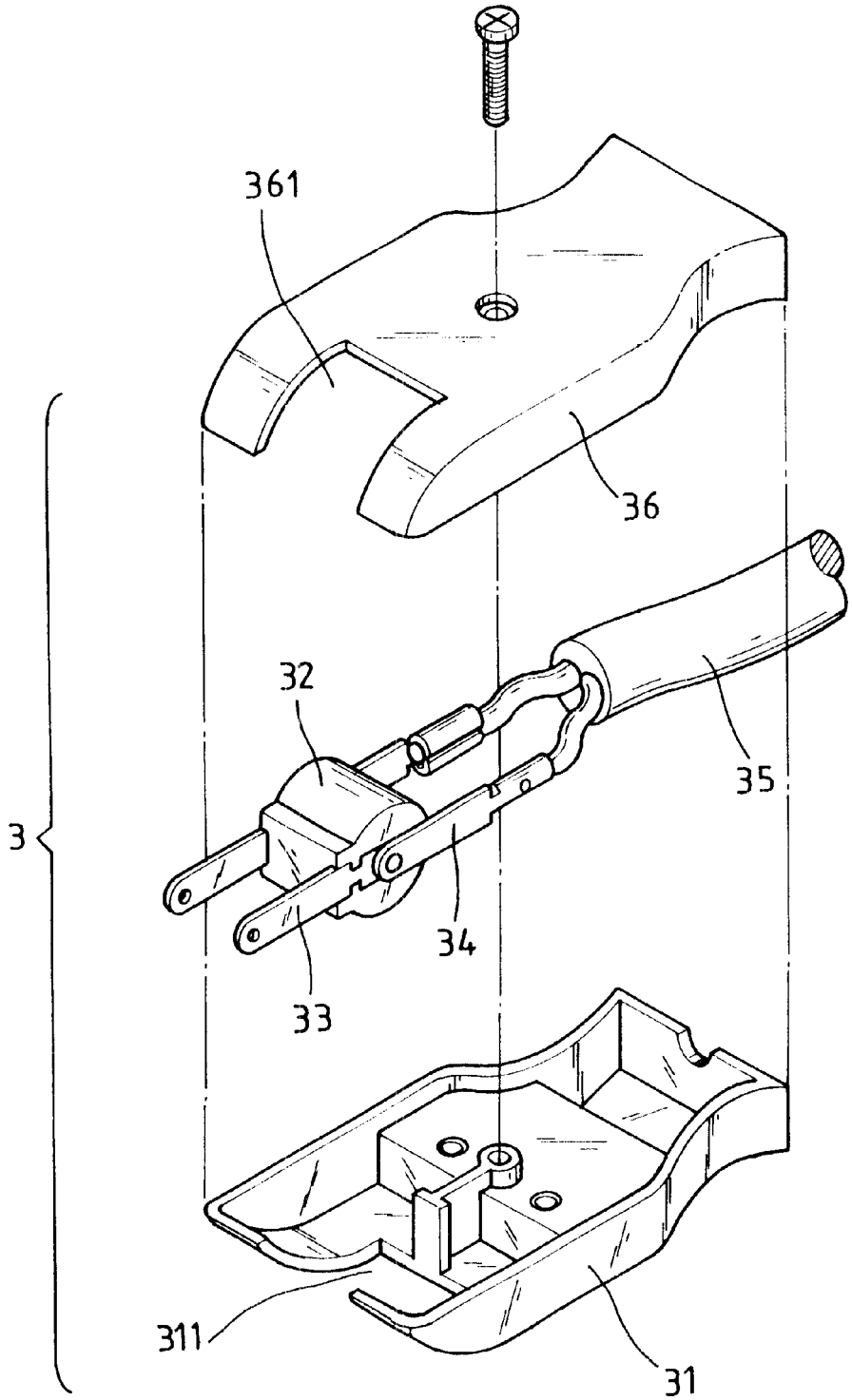
FIG. 3 PRIOR ART
FIG. 3 is an exploded view of still another structure of electric plug according to the prior art.
Figure 4:
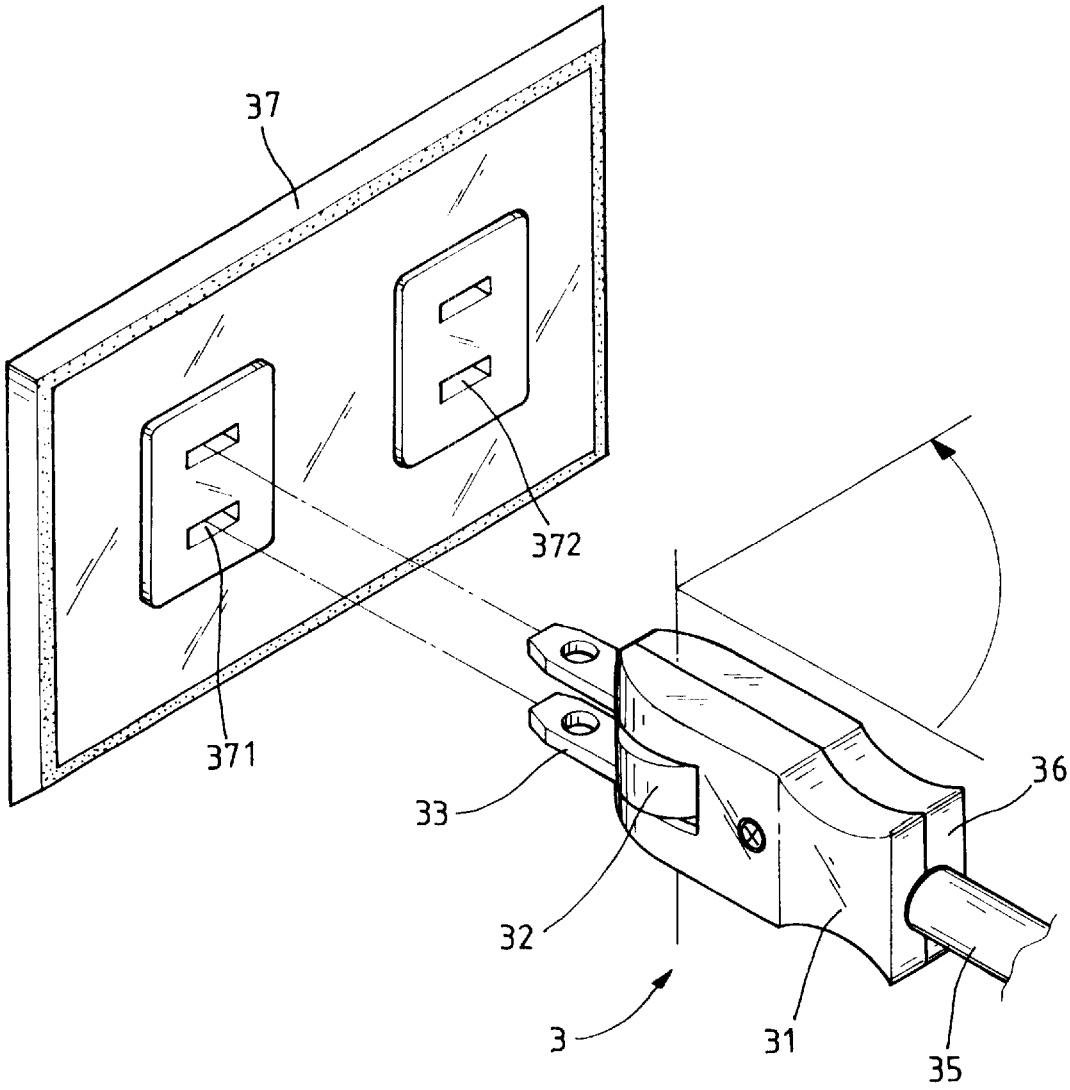
FIG. 4 PRIOR ART
FIG. 4 is a schematic drawing showing the application of the electric plug of FIG. 3.
Figure 5:
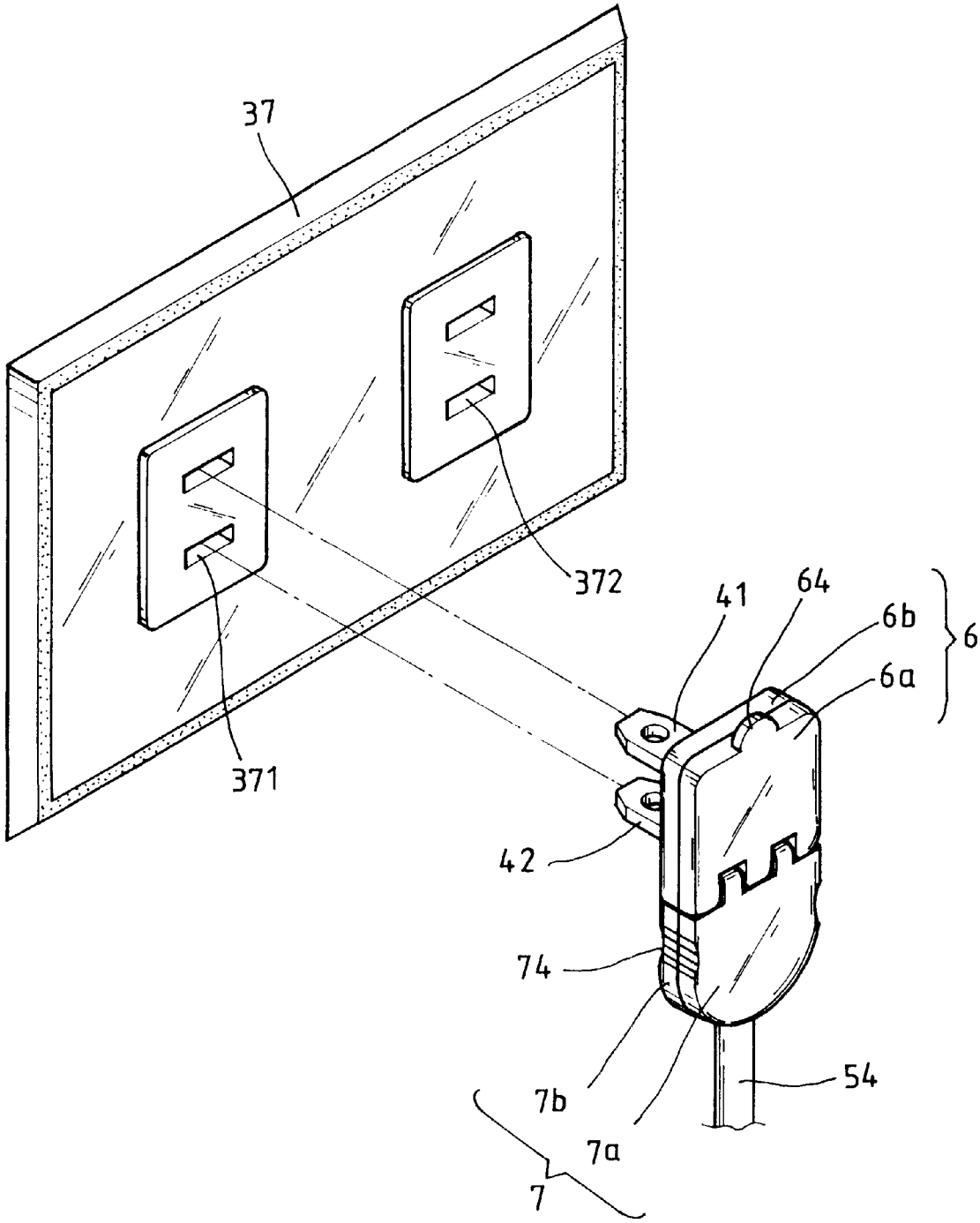
FIG. 5 is a schematic drawing showing one application example of an electric plug constructed according to the present invention.
Figure 6:
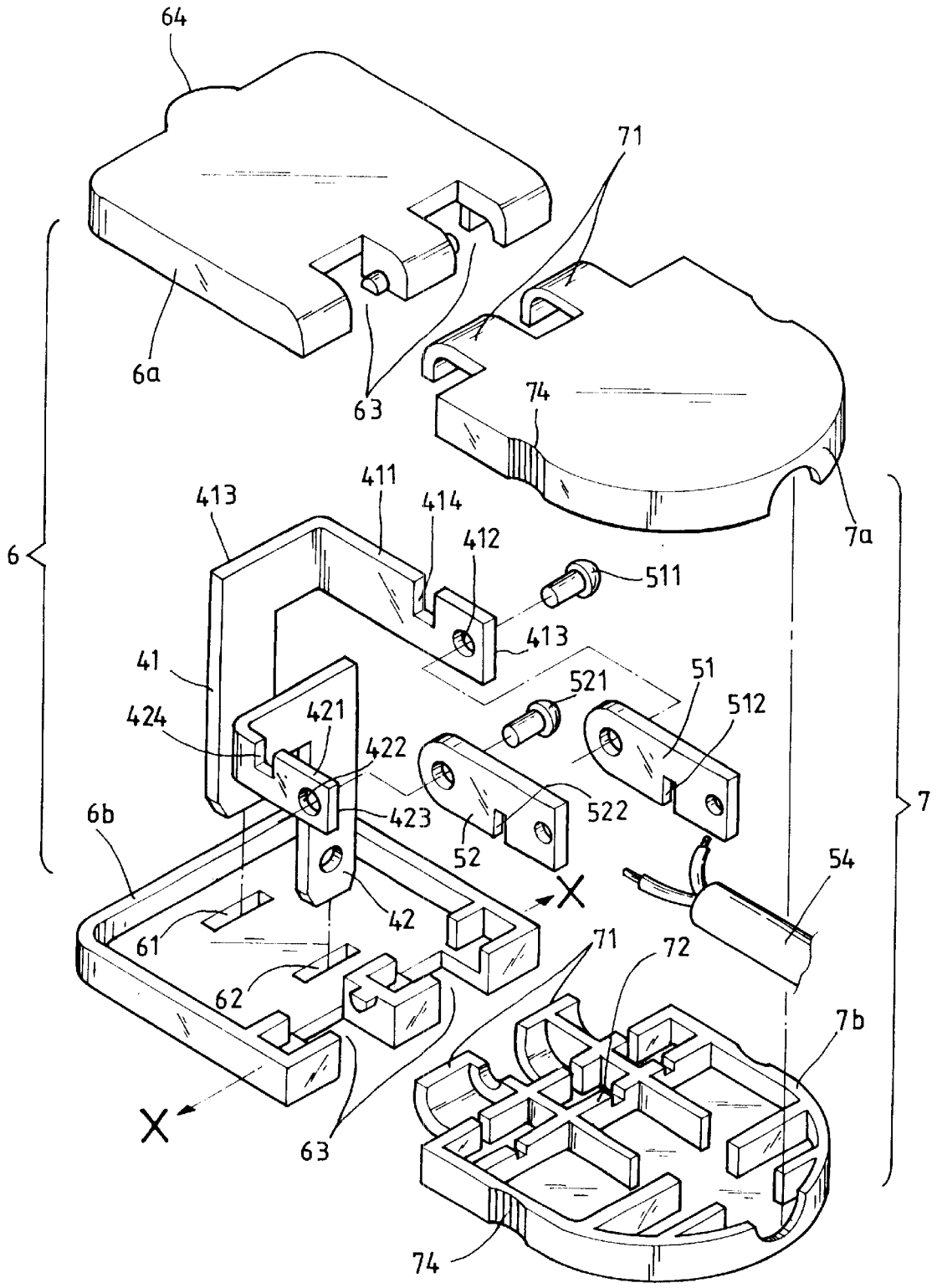
FIG. 6 is an exploded view of an electric plug according to one embodiment of the present invention.

Referring to FIGS. 5–9, an electric plug in accordance with the present invention is shown comprising two conducting blades 41; 42, two metal terminals 51; 52, a front housing 6, and a rear housing 7.

The conducting blades 41;42 are adapted for connecting to the positive and negative poles of power source, each having an extension mounting portion 411 or 421 extended from one end, namely, the rear end thereof at right angles and a pivot hole 412 or 422 in the extension mounting portion 411 or 421. The extension mounting portions 411;421 of the conducting blades 41;42 have different lengths such that the pivot holes 412;422 are aligned in axis X-X when the conducting blades 41;42 installed in the front housing 6.

The metal terminals 51;52 are respectively connected to the positive pole conductor and negative pole conductor of a power cord 54, each having a front end respectively pivotally riveted to the pivot holes 412;422 of the conducting blades 41;42 by rivets 511;521.

The front housing 6 is comprised of a top cover shell 6*a* and a bottom cover shell 6*b*. The bottom cover shell 6*b* comprises two insertion slots 61;62 through which the conducting blades 41;42 extend to the outside of the front housing 6 for inserting into the one of the socket units 371;372 of an electric outlet 37. The top cover shell 6*a* and the bottom cover shell 6*b* each have two notches 63 disposed at a rear side corresponding to the rivet position (axis X-X) between the conducting blades 41;42 and the metal terminals 51;52. After installation of the conducting blades 41;42 in the front housing 6, the conducting blades 41;42 extend perpendicularly out of the front side of the bottom cover shell 6*b* of the front housing 6 through the insertion slots 61;62 (see FIG. 8).

Figure 10:
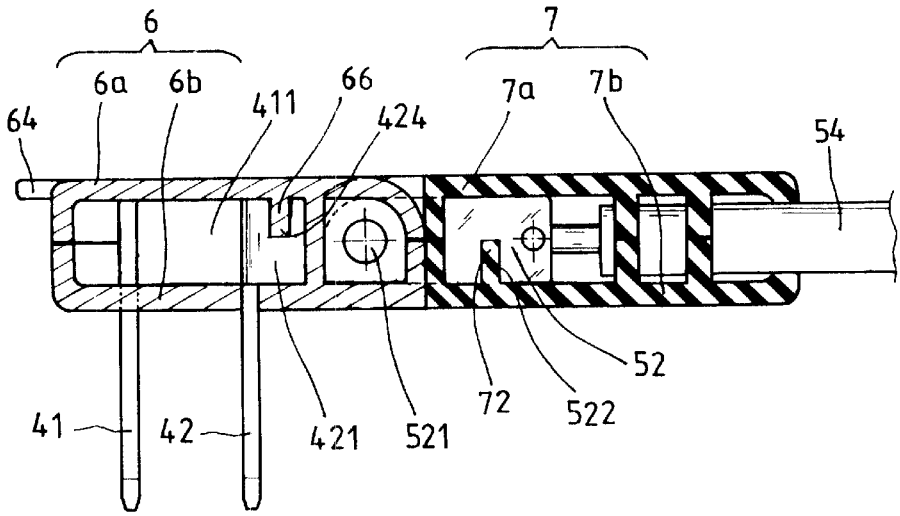
FIG. 10 is a sectional view taken along line 10—10 of FIG. 9.
Figure 11:
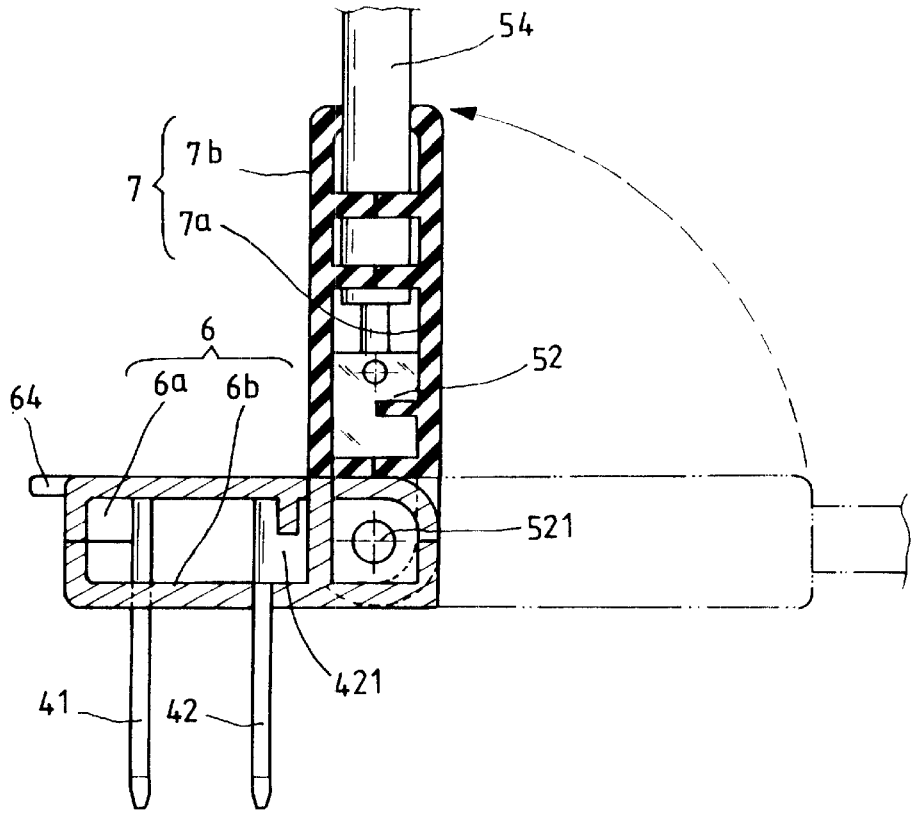
FIG. 11 is corresponding to FIG. 10, showing the rear housing turned between the first position and the second position.

The rear housing 7 is comprised of a top cover shell 7*a* and a bottom cover shell 7*b*. The top cover shell 7*a* and the bottom cover shell 7*b* are fastened together to hold the metal terminals 51;52 on the inside. The rear housing 7 has front knuckles 71 pivoted to the notches 63 of the front housing 6. When assembled, the rear housing 7 can be turned with the metal terminals 51;52 relative to the front housing 6 and the conducting blades 41;42 between a first position where the front housing 6 and the rear housing 7 are aligned on a plane (see FIG. 10), and a second position where the front housing 6 and the rear housing 7 are maintained at right angles (see FIG. 11).

Figure 7:
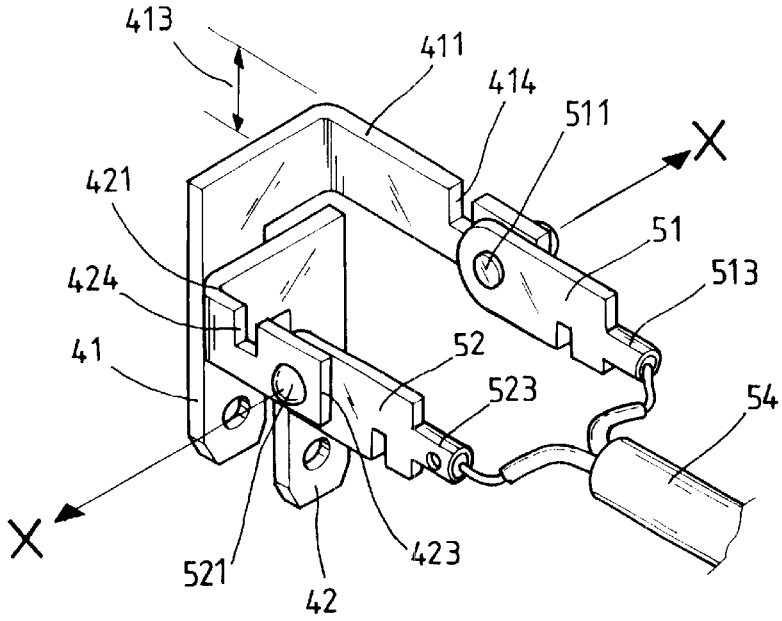
FIG. 7 is an elevational view, in a part, of the electric plug according to the present invention, showing the conducting blades respectively pivoted to the metal terminals.
Figure 7A:
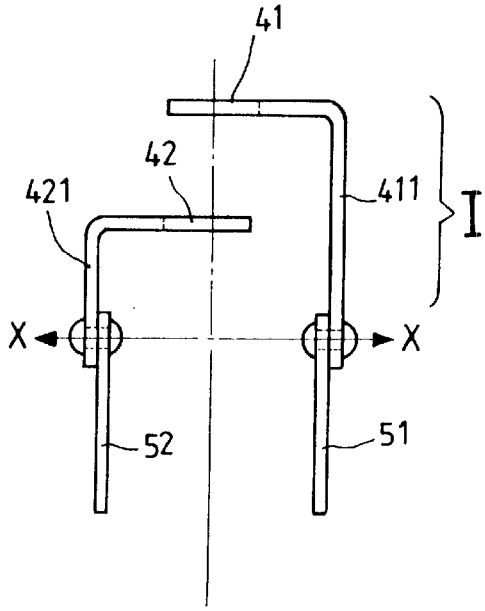
FIG. 7A is a top view of FIG. 7.

Referring to FIG. 7 and FIG. 7A, the extension mounting portions 411 or 421 are respectively extended from the conducting blades 41;42 at right angles and positioned in area I (inside the front housing 6), keeping the pivot holes 412;422 aligned on axis X-X and respectively pivoted to the metal terminals 51;52 by rivets 511;521. Further, the rear ends 513;523 of the metal terminals 51;52 can be riveted or soldered to the positive pole conductor and negative pole conductor of a power cord 54 (see FIG. 7).

Figure 7B:
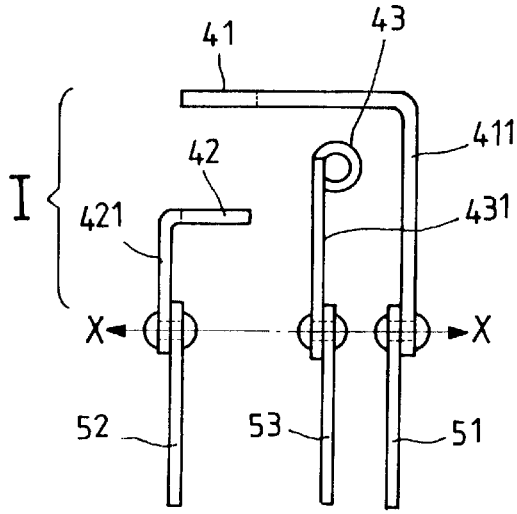
FIG. 7B is similar to FIG. 7 but showing a ground conducting blade provided and pivoted to a grounding metal terminal.
Figure 8:
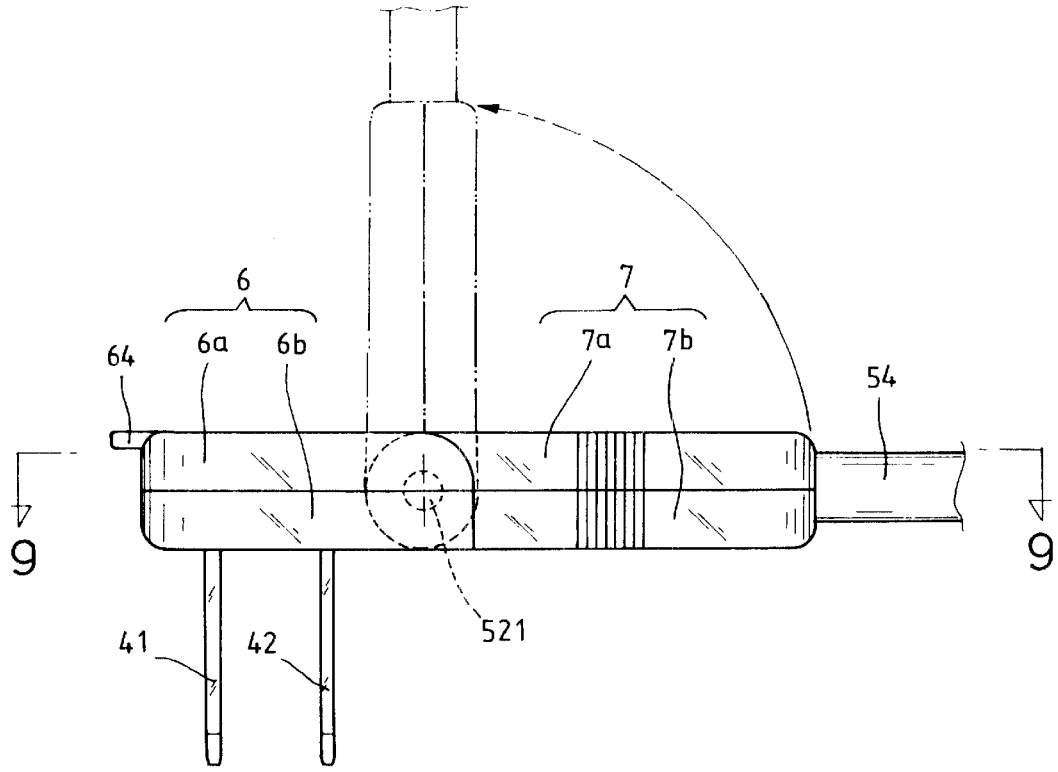
FIG. 8 is a schematic drawing of the present invention showing the rear housing turned relative to the front housing between the first position and the second position within 90°.
Figure 9:
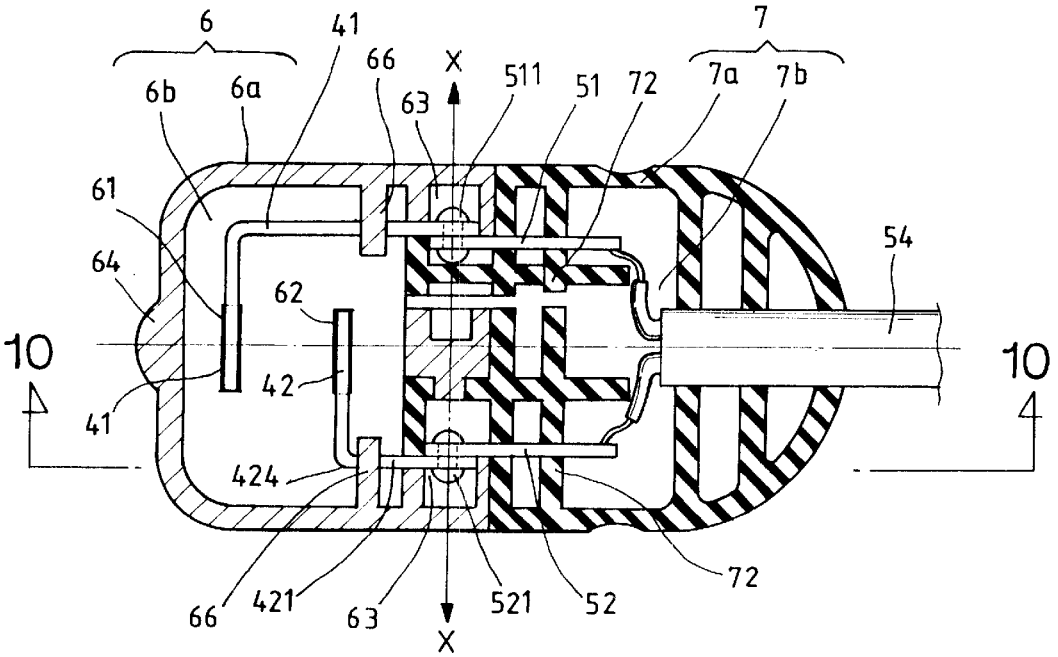
FIG. 9 is a sectional view taken along line 9—9 of FIG. 8.

Alternatively, the electric plug can be made having three blades. As shown in FIG. 7B, a grounding conducting blade 43 is provided having rear extension mounting portion 431 spaced between the extension mounting portions 411;421 of the conducting blades 41;42 and pivoted to a grounding metal terminal 53.

The top cover shell 6*a* and bottom cover shell 6*b* of the front housing 6 are respectively molded from plastics, and sealed together by a high-frequency heat sealing apparatus after installation of the conducting blades 41;42 in the bottom cover shell 6*b*. The thickness of the front housing 6 is simply slightly thicker than the heights 413;423 of the extension mounting portions 411;421 of the conducting blades 41;42. Therefore, the front housing 6 is shaped like a flat case. Because the front knuckles 71 of the rear housing 7 are pivoted to the notches 63 of the front housing 6 and the conducting blades 41;42 are respectively pivoted to the metal terminals 51;52, the rear housing 7 and the front housing 6 can be aligned on a plane without occupying much space (see FIGS. 5~8). When installed in one socket unit 371 of a multi-socket electric outlet 37, the rear housing 7 can be turned to the second position perpendicular to the front housing 6 (see FIG. 11) so as not to block the adjacent socket unit 372 of the multi-socket electric outlet 37 (see also FIG. 5)

Further, the conducting blades 41;42 and the metal terminals 51;52 have a respective locating notch 414, 424, 512, or 522 respectively engaged with a respective rib 66 or 72 in the front housing 6 or rear housing 7. The front housing 6 has a front protruded portion 64. The rear housing 7 has two recessed portions 74 at two opposite lateral sides. When the rear housing 7 turned to the second position perpendicular to the front housing 6, the user can easily pull the electric plug away from the electric outlet 37 with the fingers pressed on the recessed portions 74 and hooked on the front protruded portion 64 (see FIG. 14).

Figure 14:
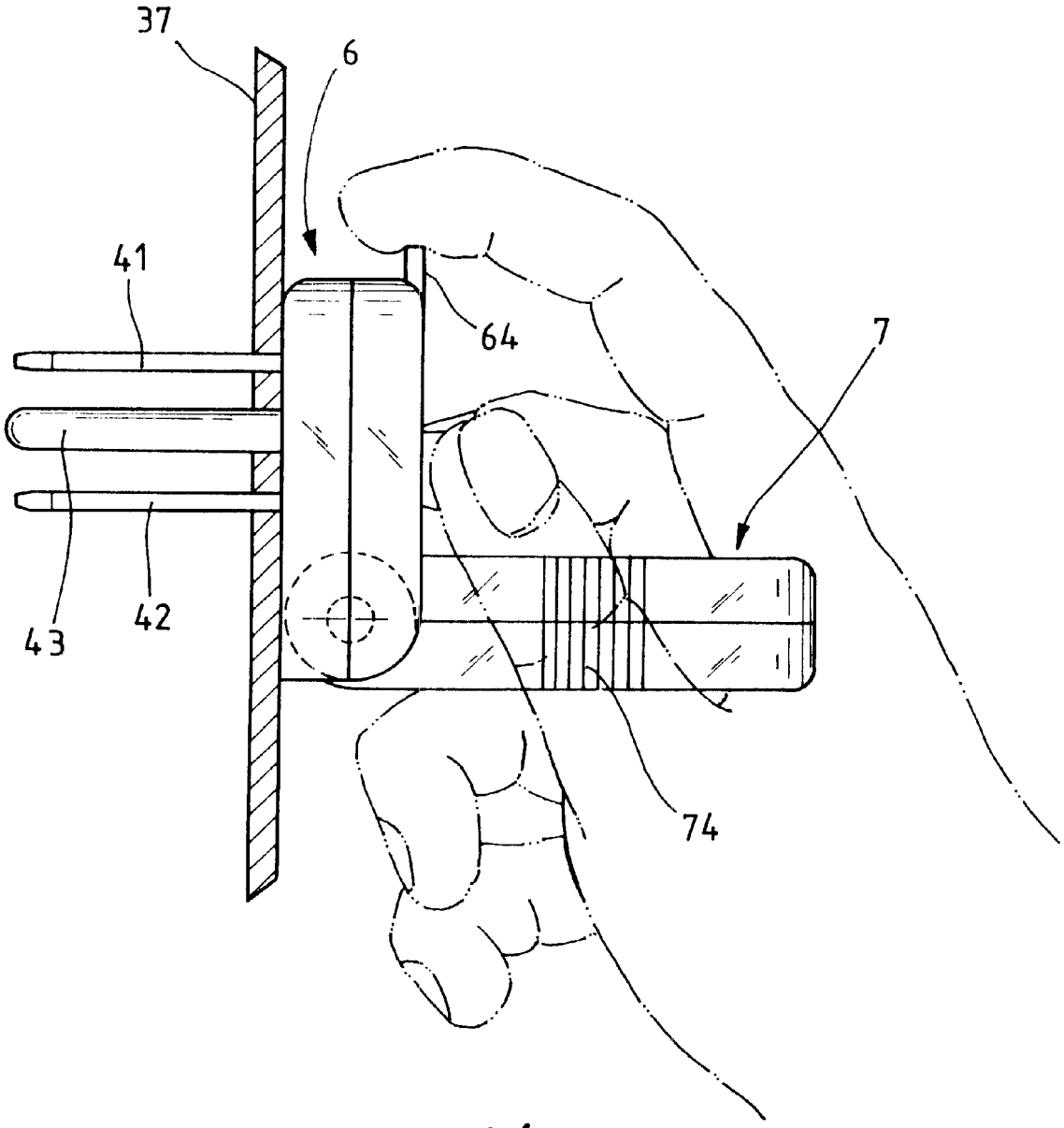
FIG. 14 is a schematic drawing showing the rear housing turned to the second position, the user's fingers pressed on the recessed portions of the rear housing and hooked on the front protruded portion of the front housing.

Because the conducting blades 41;42 extend perpendicularly out of the front side of the bottom cover shell 6*b* of the front housing 6, the front housing 6 is maintained closely attached to the electric outlet when the conducting blades 41;42 inserted into the insertion slots of the electric outlet 37 (see FIG. 14).

Figure 12:
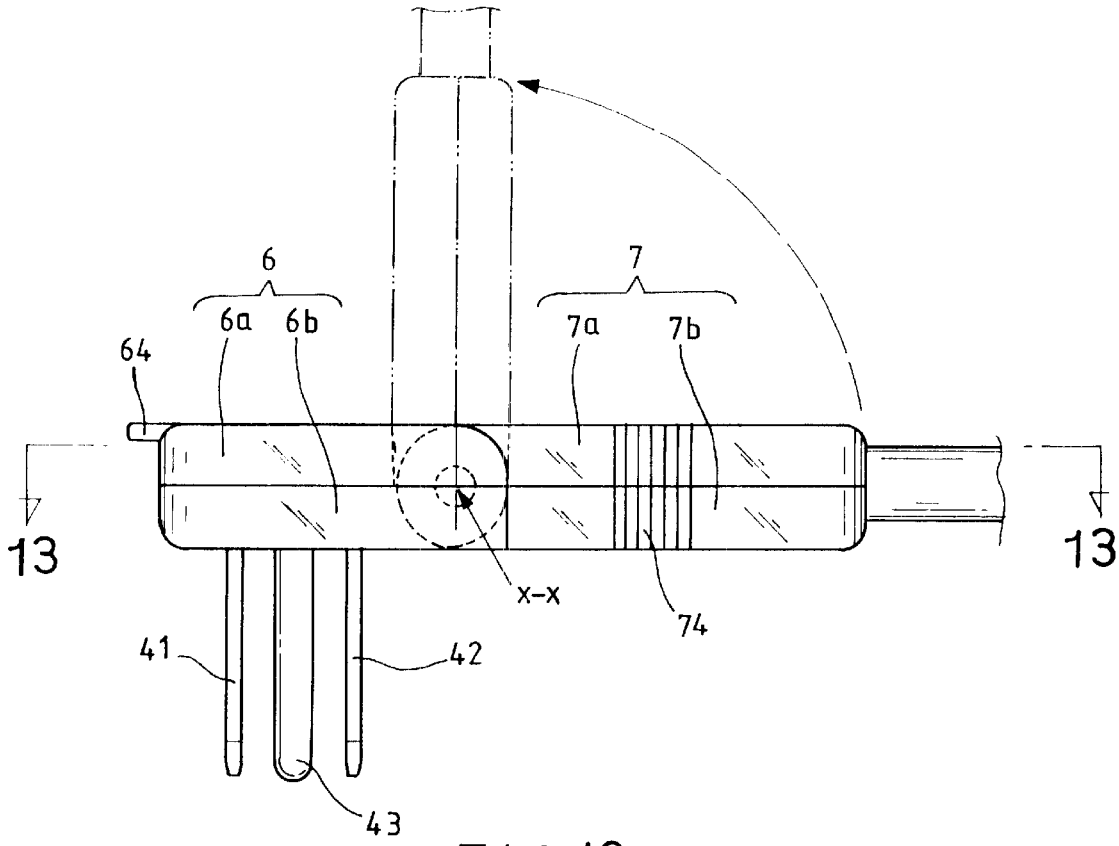
FIG. 12 is corresponding to FIG. 8 but showing the electric plug provided with a grounding conducting blade.
Figure 13:
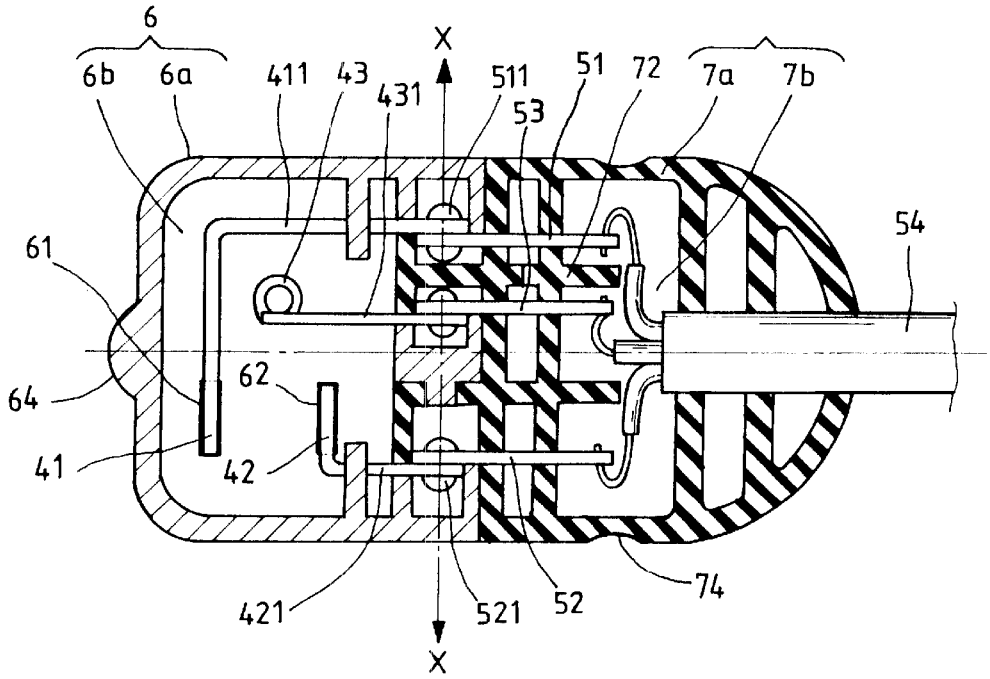
FIG. 13 is a sectional view taken along line 13—13 of FIG. 12.

Referring to FIGS. 12 and 13, the rear extension mounting portion 431 of the grounding conducting blade 43 is pivoted to the grounding metal terminal 53 in the rear housing 7 at a location in axis X-X, i.e., in line with the pivoted points between the conducting blades 41;42 and the metal terminals 51;52. Therefore, the metal terminals 51;52;53 can be turned with the rear housing 7 relative to the conducting blades 41;42;43 and the front housing 6 between the first position and the second position within 90°.

Referring to FIG. 14 again, when pulling the electric outlet outwards from the electric outlet 37 after the rear housing 7 set in the second position, the pulling force can be concentrated to the direction in axial alignment to the conducting blades 41;42;43 (the insertion slots of the electric outlet 37), therefore the user can pull the electric plug out of the electric outlet with less effort.

Figure 15:
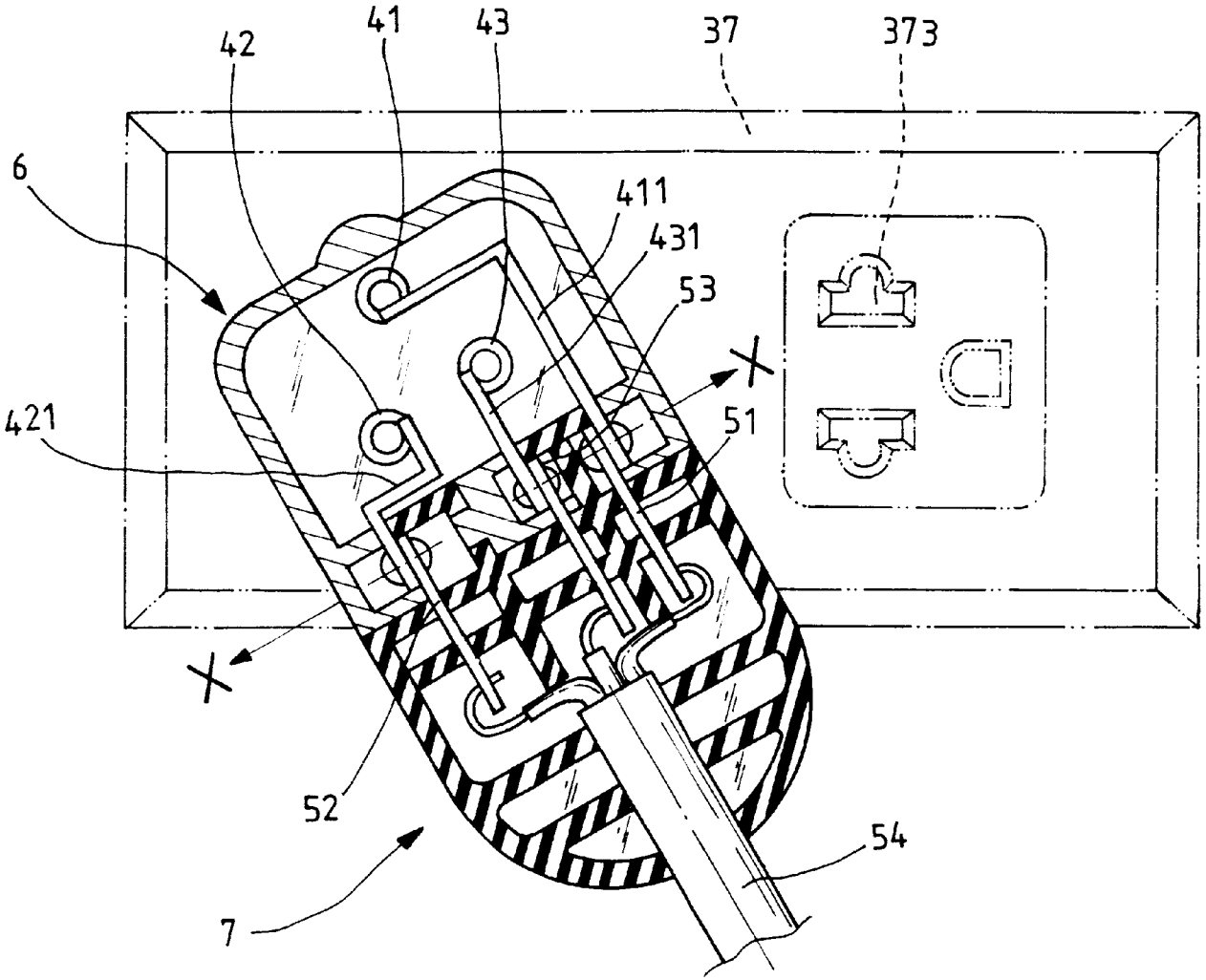
FIG. 15 illustrates another alternate form of the electric plug.

Referring to FIG. 15, the conducting blades 41;42;43 can be so positioned in the front housing 6 that the front housing 6 and rear housing 7 of the electric plug are disposed outside the electric outlet 37 in an oblique position without blocking the adjacent second socket unit 373 after insertion of the conducting blades 41;42;43 into the insertion slots of one socket unit of the electric outlet 37.

Figure 16:
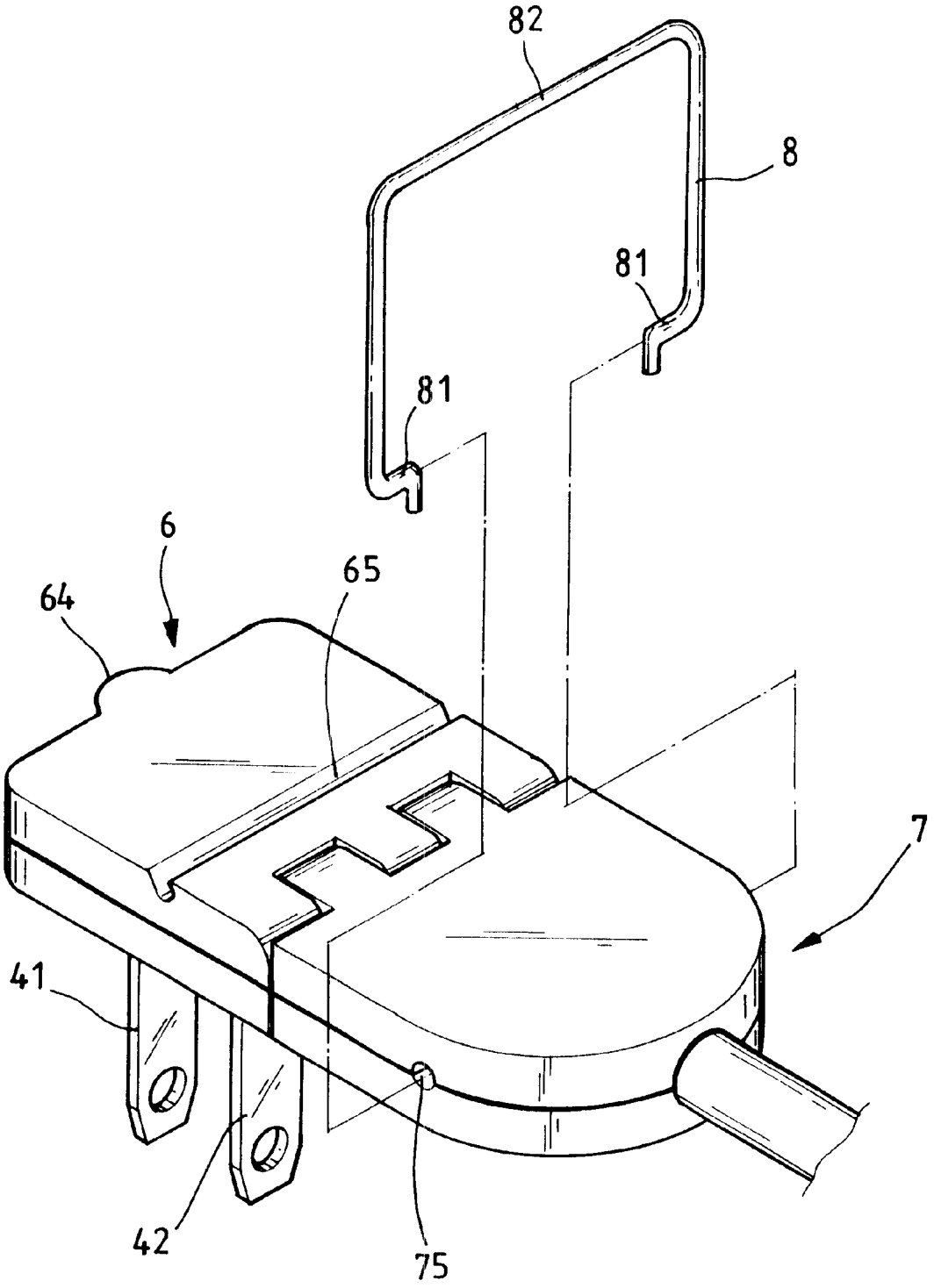
FIG. 16 is an exploded view of still another alternate form of the electric plug according to the present invention.
Figure 17:
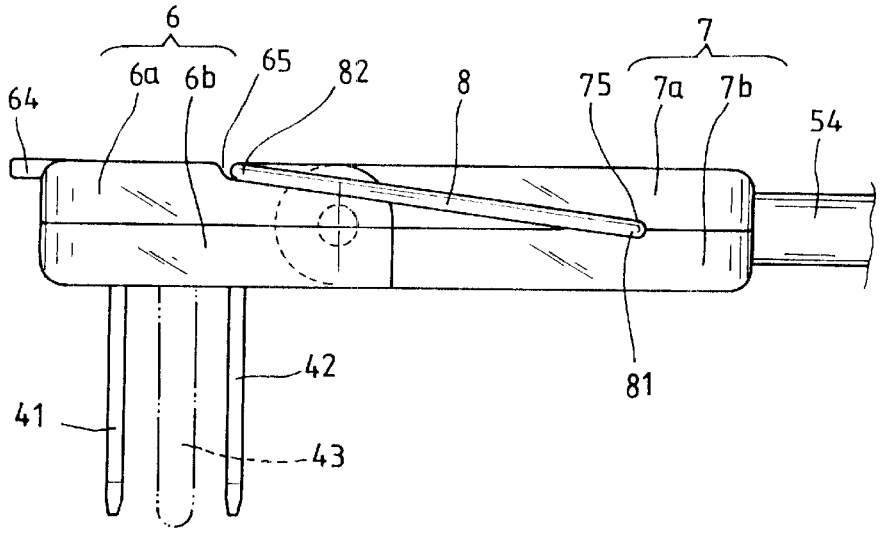
FIG. 17 is a side view of the electric plug of FIG. 16, showing the hanger hooked on the transverse locating groove of the front housing.
Figure 18:
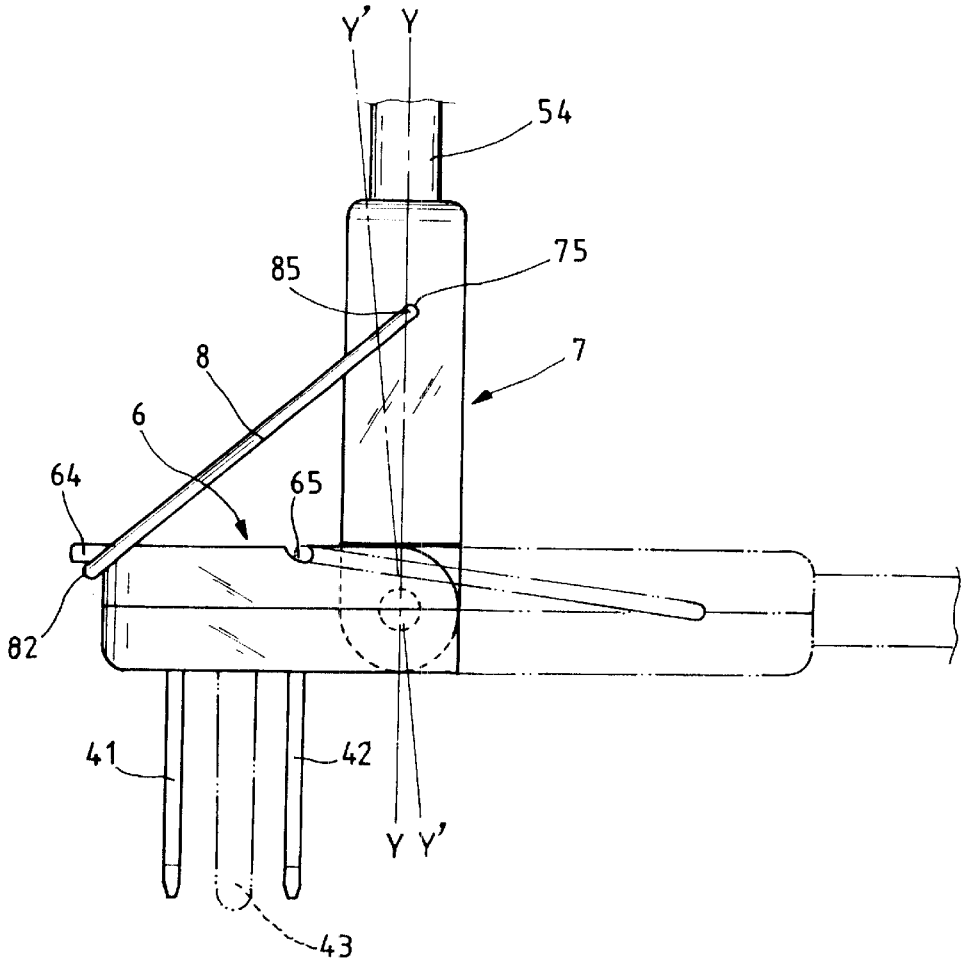
FIG. 18 is another side view of the electric plug of FIG. 16, showing the hanger hooked on the front protruded portion of the front housing.

Referring to FIGS. 16~18, a retaining member, for example, a hanger 8 is pivoted to the rear housing 7 and adapted for holding the rear housing 7 in the first position or the second position alternatively. The rear housing 7 comprises two pivot holes 75 respectively disposed at two sides. The front housing 6 comprises a transverse locating groove 65. The hanger 8 comprises a front hanger rod 82, and two endpieces 81 respectively extended from two distal ends of the front hanger rod 82 and respectively pivoted to the pivot holes 75 of the rear housing 7. When the rear housing 7 turned to the first position, the hanger rod 82 is forced into engagement with the transverse locating groove 65 of the front housing 6 to hold the rear housing 7 positively in the first position (see FIG. 17). When locking the rear housing 7 in the second position, turn the rear housing 7 to the second position and then keep forcing the rear housing 7 forwards over the vertical axis Y-Y to axis Y'-Y' (see FIG. 18) for enabling the hanger rod 82 to be moved over the front protruded portion 64 of the front housing 6 and then hooked up with the front protruded portion 64. When the hand released from the rear housing 7 after the hanger rod 82 hooked up with the front protruded portion 64 of the front housing 6, the rear housing 7 is returned to the second position in coincidence with the vertical axis Y—Y by the springy material property of the housings 6;7.

A prototype of electric plug has been constructed with the features of FIGS. 5~18. The electric plug functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An electric plug comprising:

a front housing having a bottom cover shell and a top cover shell, said front housing comprising a plurality of insertion slots in the bottom cover shell thereof, a plurality of notches in a rear side thereof, and a protruded portion extending forward from a front side thereof;

a rear housing having a bottom cover shell and a top cover shell and pivoted to said front housing, said rear housing comprising a plurality of knuckles protruded from a front side thereof and respectively pivoted to the notches of said front housing, said rear housing having at least a pair of recessed portions formed at respective opposing sides thereof for gripping by a user, whereby the user may manipulate said protruded portion to pivotally displace said front housing relative to said rear housing in leveraged manner;

a plurality of conducting blades mounted in said front housing and respectively extended out of the insertion slots of said front housing in a direction perpendicular to the front side of said front housing, said conducting blades each having a rear end extending into one of the notches of said front housing; and a plurality of metal terminals mounted in said rear housing and connected to a power cord, said metal terminals having front ends respectively pivoted to the rear ends of said conducting blades in the notches of said front housing for enabling said rear housing to be turned relative to said front housing between a first position where said front housing and said rear housing are maintained horizontally aligned, and a second position where said front housing and said rear housing are maintained at right angles.

2. The electric plug as claimed in claim 1, wherein said conducting blades include a positive pole conducting blade, a negative pole conducting blade, and a grounding conducting blade; said metal terminals include a positive pole metal terminal pivoted to said positive pole conducting blade, a negative pole metal terminal pivoted to said negative pole conducting blade, and a grounding metal terminal pivoted to said grounding conducting blade.

3. An electric plug comprising:

a front housing having a bottom cover shell and a top cover shell, said front housing comprising a plurality of insertion slots in the bottom cover shell thereof, and a plurality of notches in a rear side thereof;

a rear housing having a bottom cover shell and a top cover shell and pivoted to said front housing, said rear housing comprising a plurality of knuckles protruded from a front side thereof and respectively pivoted to the notches of said front housing;

a plurality of conducting blades mounted in said front housing and respectively extended out of the insertion slots of said front housing in a direction perpendicular to a front side of said front housing, said conducting blades each having a rear end extending into one of the notches of said front housing; and a plurality of metal terminals mounted in said rear housing and connected to a power cord, said metal terminals having front ends respectively pivoted to the rear ends of said conducting blades in the notches of said front housing for enabling said rear housing to be turned relative to said front housing between a first position where said front housing and said rear housing are maintained horizontally aligned, and a second position where said front housing and said rear housing are maintained at right angles;

said rear housing having retainer means pivoted thereto and adapted for fastening to the protruded portion of said front housing to hold said rear housing in said second position.

4. The electric plug as claimed in claim 3, wherein said front housing comprises a protruded portion protruded from the front side thereof.

5. The electric plug as claimed in claim 3, wherein said rear housing comprises two recessed portions disposed at two sides for the positioning of the user's fingers when operating the electric plug.

6. The electric plug as claimed in claim 5, wherein said front housing comprises a transverse locating groove adapted for receiving said retainer means of said rear housing to hold said rear housing in said first position.

* * * * *